US008297244B2

(12) United States Patent
Hoppe et al.

(10) Patent No.: US 8,297,244 B2
(45) Date of Patent: Oct. 30, 2012

(54) DEVICE FOR VARIABLY ADJUSTING CONTROL TIMES OF GAS EXCHANGE VALVES OF AN INTERNAL COMBUSTION ENGINE

(75) Inventors: Jens Hoppe, Erlangen (DE); Andreas Roehr, Weiden (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 220 days.

(21) Appl. No.: 12/746,349

(22) PCT Filed: Nov. 24, 2008

(86) PCT No.: PCT/EP2008/066069

§ 371 (c)(1), (2), (4) Date: Sep. 28, 2010

(87) PCT Pub. No.: WO2009/071458

PCT Pub. Date: Jun. 11, 2009

(65) Prior Publication Data

US 2011/0005482 A1 Jan. 13, 2011

(30) Foreign Application Priority Data

Dec. 5, 2007 (DE) ..... 10 2007 058 490

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

| | | | | |
|---|---|---|---|---|
| 6,684,835 | B2 | 2/2004 | Komazawa et al. | |
| 6,779,500 | B2 | 8/2004 | Kanada et al. | |
| 6,976,460 | B2 * | 12/2005 | Komazawa et al. | 123/90.15 |

FOREIGN PATENT DOCUMENTS

| | | | |
|---|---|---|---|
| DE | 199 03 624 | A | 8/1999 |
| DE | 102 28 832 | A | 1/2003 |
| DE | 10 2006 020320 | A | 11/2007 |
| EP | 0 857 859 | A | 8/1998 |
| EP | 1 672 186 | A | 6/2006 |

* cited by examiner

*Primary Examiner* — Zelalem Eshete

(74) *Attorney, Agent, or Firm* — Lucas & Mercanti, LLP; Klaus P. Stoffel

(57) ABSTRACT

A device for variably adjusting control times of gas exchange valves of an internal combustion engine. The device has a drive element, an output element, a rotation angle limiting device, and a control valve and counter-working pressure chambers. Phase adjustment between the output and drive element is initiated by applying pressure to one of the pressure chambers while discharging the other pressure chamber. The rotation angle limiting device, which can be transferred from a locked state into an unlocked state due to pressure, prevents phasing when locked and allows phasing when unlocked. The control valve has a valve housing and a control piston. An inflow connection, an outflow connection, a first and a second working connection and a third working connection are embodied on the valve housing. The working connections are offset in relation to other and do not overlap on the valve housing.

12 Claims, 5 Drawing Sheets

DEVICE FOR VARIABLY ADJUSTING CONTROL TIMES OF GAS EXCHANGE VALVES OF AN INTERNAL COMBUSTION ENGINE

This application is a 371 of PCT/EP2008/066069 filed Nov. 24, 2008, which in turn claims the priority of DE 10 2007 058 490.5 filed Dec. 5, 2007, the priority of both applications is hereby claimed and both applications are incorporated by reference herein.

FIELD OF THE INVENTION

The invention relates to a device for variably adjusting the timing control of gas exchange valves of an internal combustion engine, comprising a drive element, an output element, a rotational angle limiting device and a control valve, at least two pressure chambers, acting in opposition to one another, being provided, it being possible to initiate a phase adjustment between the output element and the drive element by admitting hydraulic fluid to one of the pressure chambers while simultaneously discharging the other pressure chamber, the rotational angle limiting device, in a locked state, preventing any variation of the phase position, the rotational angle limiting device, in an unlocked state, allowing a variation of the phase position, it being possible to bring the rotational angle limiting device from the locked to the unlocked state by the admission of hydraulic fluid, the control valve comprising a valve housing and a control piston, in each case at least one inlet connection, one outlet connection, a first and a second working connection and a third working connection (control connection) being formed on the valve housing, the inlet connection being connected to a hydraulic fluid source, the outlet connection being connected to a tank, the control connection being connected to the rotational angle limiting device and the first and the second working connections each being connected to one of the pressure chambers and the working connections being axially offset in relation to one another and being designed not to overlap on the valve housing.

BACKGROUND OF THE INVENTION

In modern internal combustion engines devices for variably adjusting the timing control of gas exchange valves are used in order to be able to vary the phase relationship between the crankshaft and the camshaft within a defined angular range, between a maximum advanced position and a maximum retarded position. For this purpose the device is integrated into a power train, via which torque is transmitted from the crankshaft to the camshaft. This power train may be embodied as a belt drive, a chain drive or a gear drive, for example.

The device includes at least two rotors turning in opposition to one another, one rotor being drive-connected to the crankshaft and the other rotor being rotationally fixed to the camshaft. The device comprises at least one pressure compartment, which is subdivided by means of a moveable element into two pressure chambers acting in opposition to one another. The moving element is operatively connected to at least one of the rotors. By feeding hydraulic fluid to the pressure chambers or discharging it from the pressure chambers, the moving element is displaced inside the pressure compartment, thereby producing a specific rotation of the rotors relative to one another and, consequently, a rotation of the camshaft relative to the crankshaft.

The flow of hydraulic fluid to and from the pressure chambers is controlled by means of a control unit, generally a hydraulic directional control valve. In turn, the control unit is controlled by means of a regulator, which with the aid of sensors determines the actual and set-point position of the camshaft relative to the crankshaft (phase position) and compares them with one another. When a difference between the two positions is detected, a signal is sent to the control unit, which adjusts the flows of hydraulic fluid to the pressure chambers to this signal.

In order to ensure that the device functions, the pressure in the hydraulic fluid circuit of the internal combustion engine must exceed a specific value. Since the hydraulic fluid is generally supplied by the oil pump of the internal combustion engine and the supplied pressure therefore increases synchronously with the rotational speed of the internal combustion engine, below a certain rotational speed, the oil pressure is still too low to vary or to maintain the phase position of the rotors with any accuracy. This may be the case, for example, during the starting phase of the internal combustion engine or during idle running phases.

During these phases the device would perform uncontrolled oscillations, which leads to increased noise emissions, increased wear, uneven running and increased raw emissions of the internal combustion engine. In order to prevent this, it is possible to provide mechanical locking devices, which, during the critical operating phases of the internal combustion engine, securely couple the two rotors rotationally together, it being possible to cancel this coupling by the admission of hydraulic fluid to the locking device. Here the locking position may be provided in one of the limit positions (maximum advanced position and maximum retarded position) or between the limit positions.

Such a device is disclosed by U.S. Pat. No. 6,684,835 B2, for example. In this embodiment the device is of vane cell construction, an outer rotor being rotatably supported on an inner rotor in the form of a vane wheel. In addition, two rotational angle limiting devices are provided, a first rotational angle limiting device in the locked state allowing an adjustment of the inner rotor in relation to the outer rotor in a range between a maximum retarded position and a defined middle position (locking position). The second rotational angle limiting device in the locked state allows a rotation of the inner rotor in relation to the outer rotor in a range between the middle position and the maximum advanced position. When both rotational angle limiting devices are in the locked state, the phase position of the inner rotor in relation to the outer rotor is limited to the middle position.

Each of the rotational angle limiting devices comprises a spring-actuated locking pin, which is located in a socket of the outer rotor. Each locking pin is subjected by means of a spring to a force acting in the direction of the inner rotor. A slotted link, which is situated opposite the locking pins in certain operating positions of the devices, is formed on the inner rotor. In these operating positions the pins can engage in the slotted link. In so doing, the respective rotational angle limiting device shifts from the unlocked into the locked state. Each of the rotational angle limiting devices can be brought from the locked into the unlocked state by the admission of hydraulic fluid to the slotted link. In this case, the hydraulic fluid forces the locking pins back into their socket, so that the mechanical coupling of the inner rotor to the outer rotor is cancelled.

The hydraulic fluid is admitted to the pressure chambers and the slotted link by means of a control valve, two working connections, which communicate with the pressure chambers, and a control connection, which communicates with the locking groove, among other things, being formed on the control valve. Other such control valves are disclosed by U.S. Pat. No. 6,779,500 B2. These control valves substantially comprise a conventional 4/3-way proportional valve, which guides the hydraulic fluid flows to and from the pressure chambers, and a 2/2-way directional control valve, which controls the hydraulic fluid flows to and from the rotational angle limiting devices, the valve parts being arranged in series. The two valve parts in this case have a common control piston and a common valve housing.

One disadvantage with these embodiments is the large overall space taken up by the control valve, particularly in an axial direction of the valve housing. Another disadvantage is the large number of control structures that have to be formed on the control piston. This leads to increased costs and larger overall dimensions. A further disadvantage is that these control valves are not suited for use as a central valve, which is arranged in a central socket of the inner rotor. For one thing, the control valves have two inlet connections, to which hydraulic fluid has to be delivered via the inner rotor of the device. This increases the complexity and the susceptibility of the device to malfunction. In addition, the device has to be of broad design in an axial direction, in order that all five connections of the valve can be covered by the socket of the inner rotor. This increases the costs of manufacturing the device. It also increases the overall dimensions and the weight.

OBJECT OF THE INVENTION

The object of the invention is to specify a device for variably adjusting the timing control of gas exchange valves of an internal combustion engine with a control valve, the intention being to achieve a control valve construction which is as simple and thereby as cost-effective as possible. It is furthermore intended to minimize the overall dimensions of the control valve.

According to the invention the object is achieved in that a first control chamber, via which two of the working connections, which are arranged directly adjacent to one another, can be selectively connected to or separated from the inlet connection according to the position of the control piston inside the valve housing, is formed on the external lateral surface of the control piston. Directly adjacent connections are taken to mean connections between which no other connection is arranged.

In one embodiment, a first control chamber, via which both the working connection and the control connection can be selectively connected to or separated from the inlet connection according to the position of the control piston inside the valve housing, is formed on the external lateral surface of the control piston.

In this case the control piston may be capable of assuming positions relative to the valve housing in which the directly adjacent working connections communicate simultaneously with the first control chamber.

In one embodiment, the control piston is capable of assuming positions relative to the valve housing in which the working connection and the control connection communicate simultaneously with the first control chamber.

In addition, a second control chamber, via which the working connection that does not communicate directly with the first control chamber, can be selectively connected to or separated from the inlet connection according to the position of the control piston inside the valve housing, may be formed on the external lateral surface of the control piston.

In this case, the connections may be arranged axially offset in relation to one another and in the order: inlet connection, first working connection, outlet connection, second working connection, control connection or inlet connection, control connection, outlet connection, second working connection, first working connection (A).

In addition, the control piston and/or the valve housing may be substantially of rotationally symmetrical design.

The working connections and control connection may be embodied as radial apertures in the valve housing.

In an advantageous development of the invention, the control valve is arranged in a central socket of the output element, the inlet connection being arranged axially outside the output element and the drive element.

In one embodiment of the invention, the control piston is of hollow design and the interior of the control piston communicates at least with the inlet connection and the first control chamber.

In this case, a third control chamber, which opens into the interior of the control piston and which communicates with the inlet connection in all positions of the control piston relative to the valve housing, may be formed on the external lateral surface of the control piston.

The control chambers may be embodied as annular grooves on the external lateral surface of the control piston.

In addition, a fourth control chamber, via which one of the adjacent working connections (A, B, S) and the working connection (A, B, S) that does not communicate with the first control chamber can be selectively connected to or separated from the outlet connection (T) according to the position of the control piston inside the valve housing, may be formed on the external lateral surface of the control piston.

The device has an actuation device, which is embodied as a hydraulic actuation drive, and a hydraulic system, which supplies the actuation device with hydraulic fluid. As in the state of the art, the actuation device may be of the vane type or axial piston type, for example. In the latter type a pressure piston, separating two pressure chambers from one another, is displaced in an axial direction by the admission of hydraulic fluid. Here, the movement of the pressure piston by way of two sets of helical teeth produces a relative phase rotation between the output element and the drive element.

In addition, mechanical means (rotational angle limiting device) are provided, in order to couple the output element mechanically to the drive element in a specific phase position. The coupling may be such, for example, that the possible phase angles are limited to an angular range or that a rotationally fixed coupling can be established between the output element and the drive element in a defined phase position. The rotational angle limiting device(s) may assume a locked state (coupling established) and an unlocked state (no coupling). The change from the locked to the unlocked state is brought about by the admission of hydraulic fluid to the rotational angle limiting device(s).

By way of the admission of hydraulic fluid to the one pressure chamber or the one group of pressure chambers with simultaneous discharging of the other pressure chamber or pressure chambers, a phase adjustment of the inner rotor 23 relative to the outer rotor 22 occurs when the rotational angle limiting device(s) is/are in the unlocked state. With the rotational angle limiting device(s) in the locked state, the phase adjustment occurs only in the range permitted by the rotational angle limiting device(s).

The hydraulic system has a control valve having a valve housing and a control piston. The valve housing may be substantially of hollow cylindrical design. Here, the connections may take the form of apertures in the cylindrical lateral surface. Inside the valve housing, a control piston can assume a plurality of positions relative to the former, thereby affording a plurality of control positions. Here, the control piston may be displaced relative to the valve housing in an axial direction of the valve housing by means of an actuation unit. The actuation unit may be of an electromagnetic or hydraulic type, for example. Each control position results in a defined connection of the various connections. The connections embodied as apertures on the lateral surface of the valve housing are arranged offset in relation to one another. The control piston and the valve housing can consequently be substantially of rotationally symmetrical design, thereby making production considerably easier. The control piston has a plurality of control structures. Provision is made here for a first control chamber, which on the one hand communicates with the inlet connection in all positions of the control piston and which on the other hand can be connected to one of the working connections and to the control connection (or the other working connection). It is possible here to provide positions of the control piston in which the first control chamber communicates solely with the working connection or the control connection (or the other working connection). In addition, it is possible to provide positions in which the first control chamber communicates with both connections. Using one control chamber to control the working connection and the control connection (or the other working connection) makes it possible to reduce the complexity of the control piston. Fewer control elements are needed, so that their elaborate machining can be dispensed with and the manufacturing costs therefore reduced. In addition the reduction in the number of control elements needed reduces the overall axial dimensions, so that use as a central valve is also feasible. A suitable arrangement of the control structures on the valve housing interacting with the first control chamber makes it possible to define the required control logic of the control valve.

The control chambers may be embodied as annular grooves on the external lateral surface of the control piston, for example. They could also feasibly be embodied as partial annular grooves.

The connection between the first control chamber and the inlet connection can be made via the interior of the hollow control piston. Hydraulic fluid entering via the inlet connection is able to pass into the interior of the control piston via piston apertures. In addition, further piston apertures may be provided, which connect the first and/or the second control chamber to the interior of the piston.

The arrangement of the connections in the order: inlet connection, working connection (or control connection), outlet connection, working connection, control connection (or working connection) means that the control valve can be provided for central valve applications. The order of the connections means that the hydraulic fluid supply of the control valve can be arranged outside the actuation device. In this case, the control valve protrudes in an axial direction from the inner rotor, the inlet connection being situated outside the inner rotor. Therefore the width of the inner rotor need only correspond to the maximum distance between the working connections, the control connection and the outlet connection. The inner rotor, and hence the actuation device, can therefore be of narrower design. Furthermore, there is no need for hydraulic fluid lines inside the inner rotor in order to carry the hydraulic fluid to the inlet connection(s), thereby simplifying the architecture of the actuation device and reducing the manufacturing costs. The central valve solution leads to a more rigid hydraulic setting of the vane in the pressure compartment.

Furthermore, the control valve may assume a first control position, in which the first working connection communicates exclusively with the tank, the second working connection communicates exclusively with the inlet connection, and the control connection communicates exclusively with the tank. In addition, a second control position may be provided in which the first working connection communicates exclusively with the tank, and the second working connection and the control connection communicate exclusively with the inlet connection. In addition, a third control position may be provided, in which the control connection communicates exclusively with the inlet connection, while the working connections communicate neither with the inlet connection nor with one of the outlet connections. In addition, a fourth control position may be provided, in which the second working connection communicates exclusively with the tank, and the first working connection and the control connection communicate exclusively with the inlet connection.

The control connection and, hence, the rotational angle limiting device(s) are therefore connected to the tank during starting of the internal combustion engine, in which the control valve assumes the first control position. The coupling between the inner rotor and the outer rotor is therefore ensured during starting. Control positions two to four allow a phase adjustment towards advanced or retarded timing or hydraulic fixing of the phase position.

BRIEF DESCRIPTION OF THE DRAWINGS

Further features of the invention are set forth in the following description and in the drawings, in which an exemplary embodiment of the invention is represented in a simplified form. In the drawings.

DETAILED DESCRIPTION OF THE DRAWINGS

Figure 1:
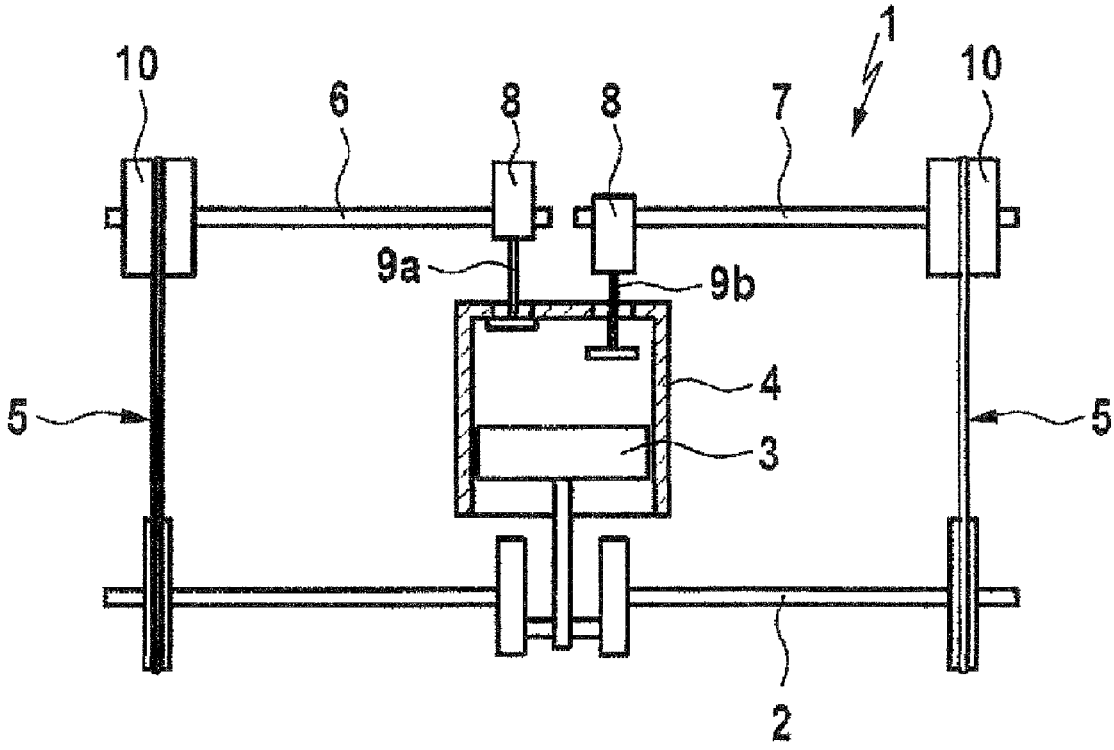
FIG. 1 shows only a very schematic representation of an internal combustion engine.

FIG. 1 is a sketch of an internal combustion engine 1, indicating a piston 3, seated on a crankshaft 2, in a cylinder 4. In the embodiment shown the crankshaft 2 is connected, in each case via a flexible drive 5, to an inlet camshaft 6 and an outlet camshaft 7, a first and a second device 10 serving to ensure a relative rotation between the crankshaft 2 and the camshafts 6, 7. Cams 8 of the camshafts 6, 7 actuate one or more intake gas exchange valves 9*a* and one or more outlet gas exchange valves 9*b*. It is similarly possible to fit just one of the camshafts 6, 7 with a device 10, or to provide just one camshaft 6, 7, which is provided with a device 10.

Figure 2A:
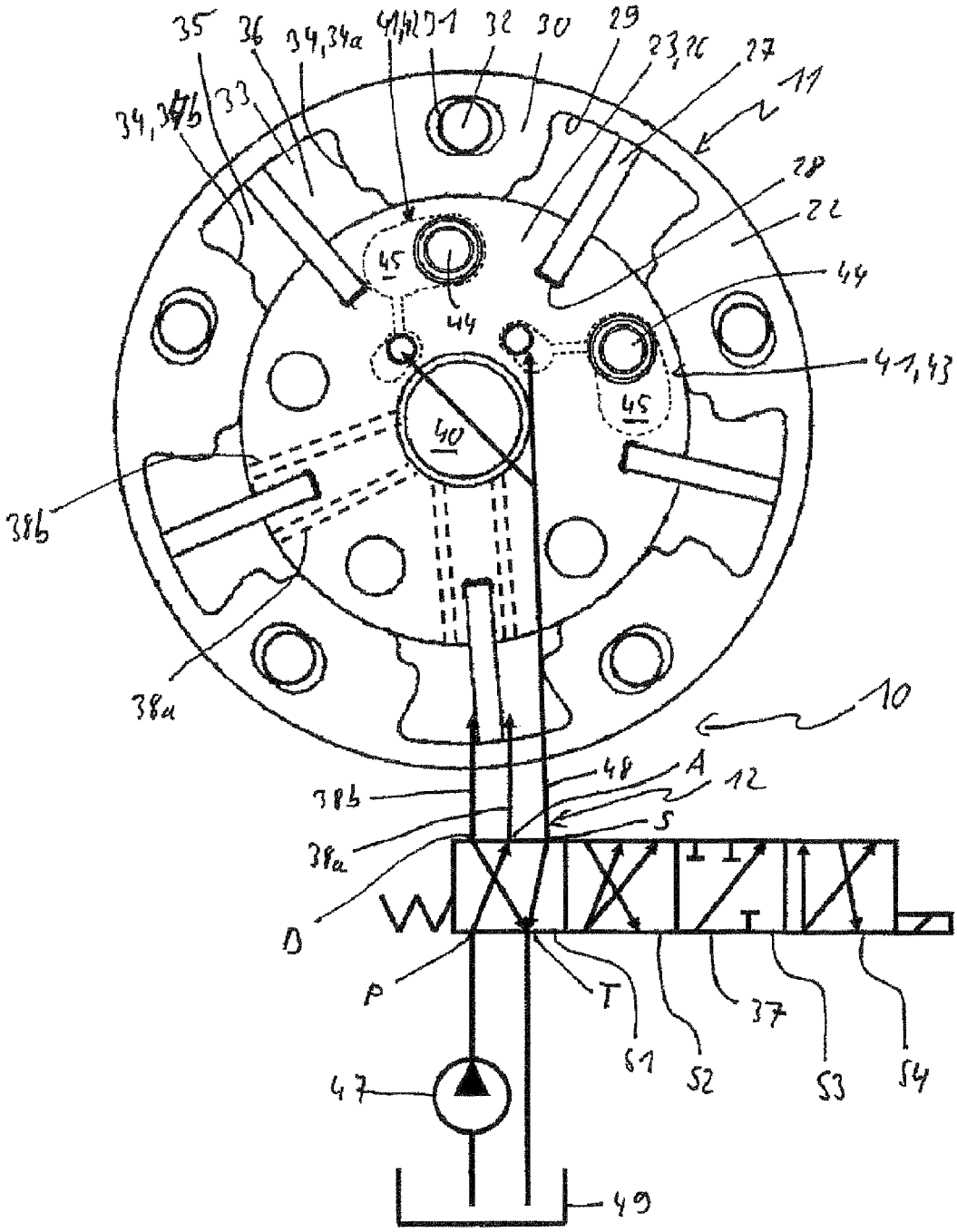
FIG. 2*a* shows a top view of a device according to the invention for adjusting the timing control of gas exchange valves of an internal combustion engine having a hydraulic circuit, the control valve only being represented schematically.
Figure 2B:
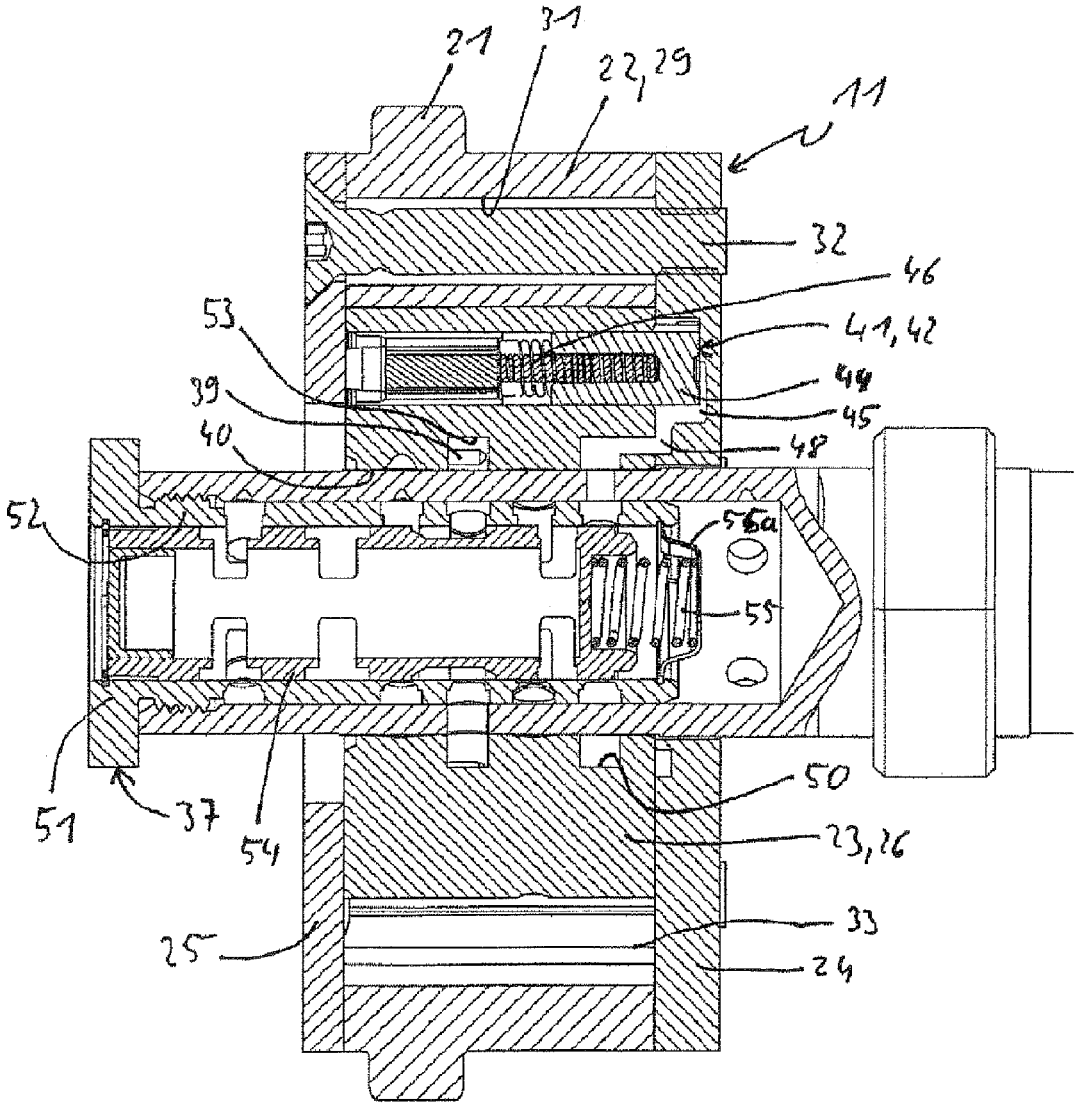
FIG. 2*b* shows a longitudinal section through the device in FIG. 2*a* along the line IIB-IIB, with the control valve.

FIGS. 2*a* and 2*b* show an embodiment of a device 10 according to the invention in top view and in longitudinal section respectively.

The device 10 has an actuation device 11 and a hydraulic system 12. The actuation device 11 has a drive element (outer rotor 22), an output element (inner rotor 23) rotationally fixed to the camshaft 6, 7, and two side covers 24, 25. The inner rotor 23 is embodied in the form of a vane wheel and has a hub element 26 substantially of cylindrical design, from the external lateral surface of which, in the embodiment shown, five vanes 27 extend radially outwards. In this case the vanes 27 may be integrally formed with the hub element 26. Alternatively, the vanes 27 may be formed separately and arranged in axially extending vane grooves 28 formed on the hub element 26, as shown in FIG. 2*a*, the vanes 27 being subjected to a force acting radially outwards by means of spring elements (not shown) arranged between the groove bases of the vane grooves 28 and the vanes 27.

From an outer circumferential wall 29 of the outer rotor 22 multiple projections 30 extend radially inwards. In the embodiment shown, the projections 30 are integrally formed with the circumferential wall 29. Embodiments in which vanes, fitted to the circumferential wall 29 and extending radially inwards, are provided instead of the projections 30, are also possible, however. The outer rotor 22 is rotatably supported o and relative to the inner rotor 23 by means of radially inner circumferential walls of the projections 30.

A chain sprocket 21, which serves to transmit torque from the crankshaft 2 to the outer rotor 22 via a chain drive (not shown), is formed on an external lateral surface of the circumferential wall 29. The chain sprocket 21 may be embodied as a separate component and rotationally fixed to the inner rotor 23 or it may be formed integrally with the latter. Alternatively, a belt drive or gear drive may also be provided.

One of the side covers 24, 25 is arranged on each of the axial side faces of the outer rotor 22 and rotationally fixed thereto. For this purpose an axial aperture 31 is provided in each of the projections 30, a fastening element 32, for example a bolt or a screw, which serves for rotationally fixed attachment of the side covers 24, 25 to the outer rotor 22, passing through each axial aperture 31.

A pressure compartment 33, which is defined in a circumferential direction by opposing boundary walls 34 of adjacent projections 30 extending substantially radially, in an axial direction by the side covers 24, 25, radially inwards by the hub element 26 and radially outwards by the circumferential wall 29, is formed inside the device 10 between each two circumferentially adjacent projections 30. A vane 27 projects into each of the pressure compartments 33, the vanes 27 being formed in such a way that they rest against both the side walls 24, 25 and the circumferential wall 29. Each vane 27 therefore divides the respective pressure compartment 33 into two pressure chambers 35, 36 acting in opposition to one another.

The outer rotor 22 is arranged so that it can rotate relative to the inner rotor 23 in a defined angular range. The angular range is limited in one direction of rotation of the inner rotor 23 in that each vane 27 comes to bear against a boundary wall 34 of the pressure compartment 33 designed as advance limit stop 34*a* (advanced timing control). Similarly, the angular range in the other direction of rotation is limited in that each vane 27 comes bear against the other boundary wall 34 of the pressure compartment 33, which serves as retard limit stop 34*b* (retarded timing control). Alternatively, a rotation limiting device, which limits the rotational angle range of the outer rotor 22 relative to the inner rotor 23, may be provided.

By pressurizing one group of pressure chambers 35, 36 and relieving the other group, it is possible to vary the phase position of the outer rotor 22 relative to the inner rotor 23 and thereby the position of the camshaft 6, 7 relative to the crankshaft 2. By pressurizing both groups of pressure chambers 35, 36, the phase position of the two rotors 22, 23 relative to one another can be kept constant. Alternatively, hydraulic fluid may be admitted to none of the pressure chambers 35, 36 during phases of constant phase position. The lubricating oil of the internal combustion engine 1 is generally used as hydraulic fluid.

During starting of the internal combustion engine 1 or during idling phases, the hydraulic fluid supply of the device 10 may not be sufficient to ensure hydraulic setting of the vanes 27 inside the pressure compartments 33. In order to prevent an uncontrolled oscillation of the inner rotor 23 in relation to the outer rotor 22, a locking mechanism 41, which establishes a mechanical connection between the two rotors 22, 23, is provided. Here, the locking position may be situated in one of the limit positions of the inner rotor 23 relative to the outer rotor 22. In this case, a rotational angle limiting device 42 is provided, a locking pin 44 being located in one of the rotors 22, 23 and a slotted link 45, which is matched to the locking pin 44, being formed in the other rotor 22, 23. When the inner rotor 23 is in the locking position, the locking pin 44 can engage in the slotted link 45 and therefore establish a mechanical, rotationally fixed connection between the two rotors 22, 23.

It has proved advantageous to select the locking position so that when the device 10 is in the locked state the vanes 27 are situated in a position between the advance limit stop 34*a* and the retard limit stop 34*b*. Such a locking mechanism 41 is represented in FIG. 2*a*. This comprises a first and a second rotational angle limiting device 42, 43. In the embodiment shown each of the rotational angle limiting devices 42, 43 comprises an axially displaceable locking pin 44, each of the locking pins 44 being received in a hole in the inner rotor 23. Furthermore, two slotted links 45 in the form of circumferentially running grooves are formed in the first side wall 24. In FIG. 2*a* these grooves are indicated in the form of broken lines. Each of the locking pins 44 is subjected by means of a spring element 46 to a force acting in the direction of the first side cover 24. When the inner rotor 23 assumes a position relative to the outer rotor 22, in which a locking pin 44 is situated axially opposite the associated slotted link 45, it is forced into the slotted link 45 and the respective rotational angle limiting device 42, 43 is brought from an unlocked state into a locked state. Here, the slotted link 45 of the first rotational angle limiting device 42 is designed in such a way that, when the first rotational angle limiting device 42 is locked, the phase position of the inner rotor 23 relative to the outer rotor 22 is limited to a range between a maximum retarded position and the locking position. When the inner rotor 23 is in the locking position relative to the outer rotor 22, the locking pin 44 of the first rotational angle limiting device 42 bears against a limit stop formed in a circumferential direction by the slotted link 45, thereby preventing any further adjustment towards advanced timing.

Similarly, the slotted link 45 of the second rotational angle limiting device 43 is designed in such a way that with the second rotational angle limiting device 43 locked the phase position of the inner rotor 23 relative to the outer rotor 22 is limited to an area between a maximum advanced position and the locking position.

In order to bring the rotational angle limiting devices 42, 43 from the locked position into the unlocked position, hydraulic fluid is admitted to the respective slotted link 45. This forces the respective locking pin 44 back into the hole against the force of the spring element 46, thereby cancelling the rotational angle limitation.

Multiple hydraulic fluid lines 38*a*,*b*, control lines 48, a control valve 37, a hydraulic fluid pump 47 and a tank 49 are provided for supplying hydraulic fluid to the actuation device 11.

First and second hydraulic fluid lines 38*a*, 38*b* are provided inside the inner rotor 23. The first hydraulic fluid lines 38*a* extend from the first pressure chambers 35 to a central socket 40 of the inner rotor 23. The second hydraulic fluid lines 38*b* likewise extend from the second pressure chambers 36 to the central socket 40. For reasons of clarity, in FIG. 2*a*, the hydraulic fluid lines 38*a,b* are shown only for two pressure compartments 33.

For the admission of hydraulic fluid to the rotational angle limiting devices 42, 43 control lines 48 are provided, which extend from a first annular groove 50 in the central socket 40 of the inner rotor 23 via the first side cover 24 to the slotted links 45. Here, the first annular groove 50 communicates with the slotted links 45 in all phase positions of the device 10.

A control valve 37 is arranged inside the socket 40 of the inner rotor 23. In the embodiment shown, the control valve 37 is accommodated in a hollow camshaft 6, 7, which passes through the socket 40 of the inner rotor 23. Here, the inner rotor 23 is rotationally fixed to the camshaft 6, 7, for example by means of a non-positive or cohesive material connection.

The control valve 37 has a first working connection A and a second working connection B, an inlet connection P, a third working connection (control connection S) and outlet connections T, $T_a$. Via the inlet connection P, hydraulic fluid can be delivered to the control valve 37 by a hydraulic fluid pump 47. The first working connection A and the second working connection B communicate with the first and second hydraulic fluid lines 38*a,b*, respectively. The control connection S communicates with the control lines 48. Via the outlet connections T, $T_a$, hydraulic fluid can be discharged from the control valve 37 to a tank 49.

Furthermore, the control valve 37 can be brought into four control positions S1-S4 (FIG. 2*a*). In the first control position S1, the second working connection B communicates with the inlet connection P, while both the first working connection A and the control connection S are connected to the outlet connections T, $T_a$. This control position S1 is assumed during the starting phase of the internal combustion engine 1. In this phase, the hydraulic setting of the vanes 27 inside the pressure compartments 33 is generally not assured due to the system pressure being too low. Since the slotted links 45 of both rotational angle limiting devices 42, 43 are connected to the tank 49 via the control lines 48 and the control valve 37, both rotational angle limiting devices 42, 43 assume the locked state. The inner rotor 23 is therefore mechanically connected to the outer rotor 22, thereby fixing the phase position in the locking position. Since in this position of the control valve 37 the rotational angle limiting devices 42, 43 are not connected to the hydraulic fluid pump 47 but to the tank 49, there is no risk of accidental unlocking. The capacity of the internal combustion engine 1 to start is thereby assured and at the same time exhaust emissions are reduced.

The control positions S2-S4 of the control valve 37 represent the control positions of the device 10 in which an adjustment towards retarded timing (second control position S2) or an adjustment towards advanced timing (fourth control position S4) occurs or the timing is kept constant (third control position S3). In these control positions S2-S4, the slotted links 45 of the rotational angle limiting devices 42, 43 are connected to the hydraulic fluid pump 47 via the control lines 48 and the control valve 37. System pressure therefore prevails on the end face of the locking pins 44, with the result that the rotational angle limiting devices 42, 43 assume the unlocked state and allow a phase adjustment of the inner rotor 23 relative to the outer rotor 22.

In the second control position S2, both the second working connection B and the control connection S communicate with the inlet connection P, while the first working connection A is connected to the outlet connection T. The hydraulic fluid pump 47 therefore delivers hydraulic fluid to the second pressure chambers 36 via the control valve 37 and the second hydraulic fluid lines 38*b*. At the same time, hydraulic fluid is discharged from the first pressure chambers 35 via the first hydraulic fluid lines 38*a* and the control valve 37 to the tank 49. The vanes 27 are consequently moved inside the pressure compartments 33 towards the retard limit stops 34*b*. This results in a relative change in the phase position of the camshaft 6, 7 relative to the crankshaft 2 towards retarded timing.

In the third control position 53, only the control connection S communicates with the inlet connection P, while the first working connection A and the second working connection B are connected neither to the tank 49 nor to the outlet connections T, $T_a$. Therefore hydraulic fluid is neither fed to nor discharged from the pressure chambers 35, 36. The vanes 27 are hydraulically set, so that the phase position of the inner rotor 23 relative to the outer rotor 22 and hence of the camshaft 6, 7 relative to the crankshaft 2 is fixed.

In the fourth control position S4, both the first working connection A and the control connection S communicate with the inlet connection P, while the second working connection B is connected to the outlet connection T. The hydraulic fluid pump 47 therefore delivers hydraulic fluid to the first pressure chambers 35 via the control valve 37 and the first hydraulic fluid lines 38*a*. At the same time, hydraulic fluid is discharged from the second pressure chambers 36 via the second hydraulic fluid lines 38*b* and the control valve 37 to the tank 49. The vanes 27 are consequently moved inside the pressure compartments 33 towards the advance limit stops 34*a*. This results in a relative change in the phase position of the camshaft 6, 7 relative to the crankshaft 2 towards advanced port timing.

The control valve 37 is represented in FIGS. 3*a-d*. It comprises an actuation unit (not shown) and a hydraulic section 51. The hydraulic section 51 comprises a substantially hollow cylindrical valve housing 52 and a control piston 54. The valve housing 52 has the connections A, B, P, S, T, $T_a$. With the exception of the axial outlet connection $T_a$, the connections A, B, P, S, T are embodied as apertures in the cylindrical wall of the valve housing 52, which open into annular grooves, which are formed on the external lateral surface of the valve housing 52. The working connections A, B communicate via apertures in the camshaft 6, 7 with the first and second hydraulic fluid lines 38*a,b*, respectively. The control connection S corn and second hydraulic fluid lines 38*a,b*. The control connection S communicates via apertures in the camshaft 6, 7 with the first annular groove 50 in the inner rotor 23, into which the control lines 48 open.

The outlet connection T communicates via further apertures in the camshaft 6, 7 with a second annular groove 53, which is formed in the socket 40 of the inner rotor 23. In this case, the second annular groove 53 is connected via an axial bore 39 to the exterior of the device 11.

The connections A, B, P, S, T are axially offset in relation to one another and are arranged in the order: inlet connection P, first working connection A, outlet connection T, second working connection B, control connection S. Apart from the inlet connection P, all connections here are located inside the socket 40 (FIG. 2*b*). The inlet connection P protrudes axially from the actuation device 11. The hydraulic fluid can thereby be delivered to the control valve 37 outside the actuation device 11. This eliminates the need to provide a feed line, via which the hydraulic fluid reaches the control valve 37, inside the inner rotor 23. The architecture of the inner rotor 23 is thereby simplified considerably.

The axial outlet $T_a$ is configured as an axial aperture in the valve housing 52.

The control piston 54 is substantially of hollow cylindrical design and is arranged so that it is axially displaceable inside the valve housing 52. Here, the axial position of the control piston 54 can be continuously adjusted by means of the actuation unit (not shown). The actuation unit acts in opposition to the force of a spring 55, which moves the control piston 54 into an initial position when the actuation unit is inactive. The spring 55 is supported on a spring plate 55*a*, which is fixed in the axial aperture, which forms the axial outlet connection $T_a$. The actuation unit 50 may be embodied as an electrical actuation unit, for example.

The control piston 54 has four axially spaced control chambers 56*a, b, c, d*. In the embodiment shown the control chambers 56*a, b, c, d* are embodied as annular grooves in the external lateral surface of the control piston 54. With the exception of the fourth control chamber 56*d*, the control chambers 56*a, b, c* communicate via piston apertures 57*a, b, c* with the interior of the control piston 54. The control chambers 56*a-d* are each defined by two annular webs 58*a-e*. Here, the first annular web 58*a* defines the first control chamber 56*a* in the direction of the axial outlet connection $T_a$, and the fifth annular web 58*e* defines the inlet connection P in the direction of the actuation unit (not shown). The second annular web 58*b* separates the first control chamber 56*a* from the fourth control chamber 56*d*. The third annular web 58*c* separates the fourth control chamber 56*d* from the second control chamber 56*b*. The fourth annular web 58*d* separates the second control chamber 56*b* from the third control chamber 56*c*.

The control chambers 56*a-d* communicate with different connections A, B, P, S, T, $T_a$, depending on the relative position of the control piston 54 in relation to the valve housing 52.

The first control chamber 56*a* is arranged in such a way that communication can be established with the second working connection B and the control connection S.

The second control chamber 56*b* is arranged in such a way that communication can be established with the first working connection A.

The third control chamber 56*c* communicates with the inlet connection P in all positions of the control piston 54.

The fourth control chamber 56*d* is arranged in such a way that communication can be established with the second working connection B or the first working connection A. Here, the fourth control chamber 56*d* always communicates with the outlet connection T.

Figure 3A:
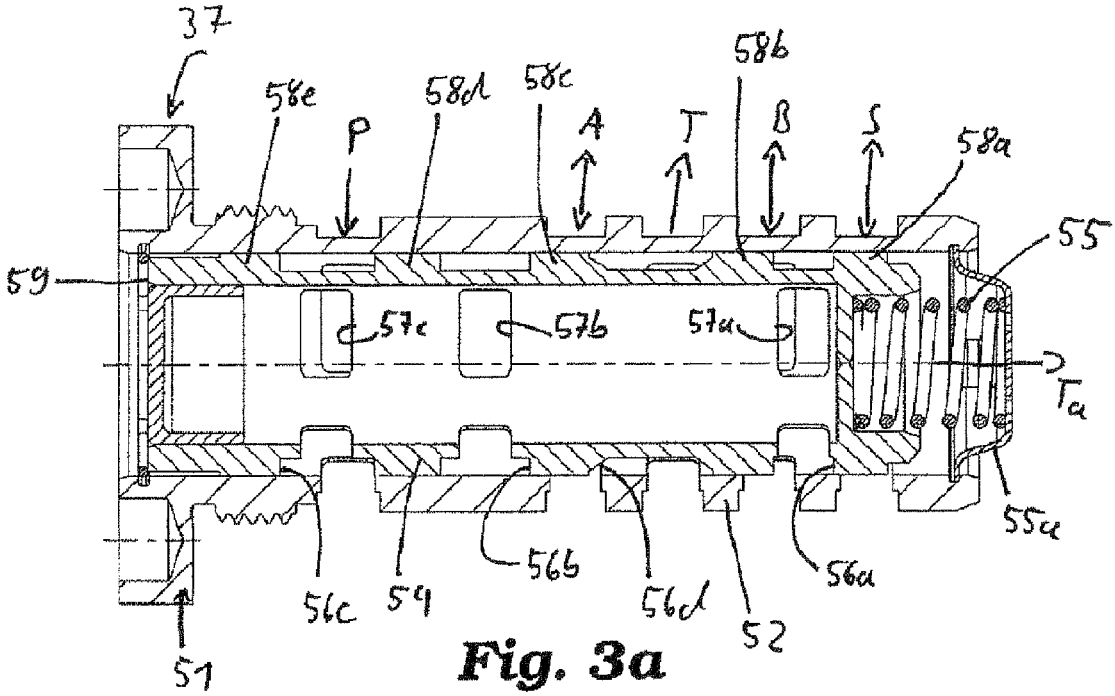
FIGS. 3*a*-3*d* each show a longitudinal section through the control valve in FIG. 2*b* in its various control positions.

The working of the control valve 37 is explained with reference to FIGS. 3*a-d*. The figures differ from one another in the relative position of the control piston 54 in relation to the valve housing 52. In FIG. 3*a* the control valve 37 is shown in a state in which the actuation unit is inactive. The spring 55 forces the control piston 54 into an initial position, in which it bears against a first limit stop 59. In the following FIGS. 3*b-c* the control piston 54 is displaced against the force of the spring 55 by an increasing length of travel relative to the valve housing 52.

In the state of the control valve 37 represented in FIG. 3*a*, hydraulic fluid passes via the inlet connection P to the third control chamber 56*c* and the third piston apertures 57*c* into the interior of the control piston 54. From there the hydraulic fluid passes via the first piston apertures 57*a* and the first control chamber 56*a* to the second working connection B. At the same time, a hydraulic fluid flow to the control connection S and the first working connection A is blocked by the second and third annular web 58*b,c* respectively. The first working connection A is connected by means of the fourth control chamber 56*d* to the outlet connection T and the control connection S is connected to the axial outlet connection $T_a$.

Hydraulic fluid consequently passes from the hydraulic fluid pump 47 via the control valve 37 to the second pressure chambers 36, while hydraulic fluid is discharged from the slotted links 45 and the first pressure chambers 35 to the tank 49. The rotational angle limiting devices 42, 43 are consequently in the locked state and therefore prevent a phase adjustment of the inner rotor 23 relative to the outer rotor 22.

Figure 3B:
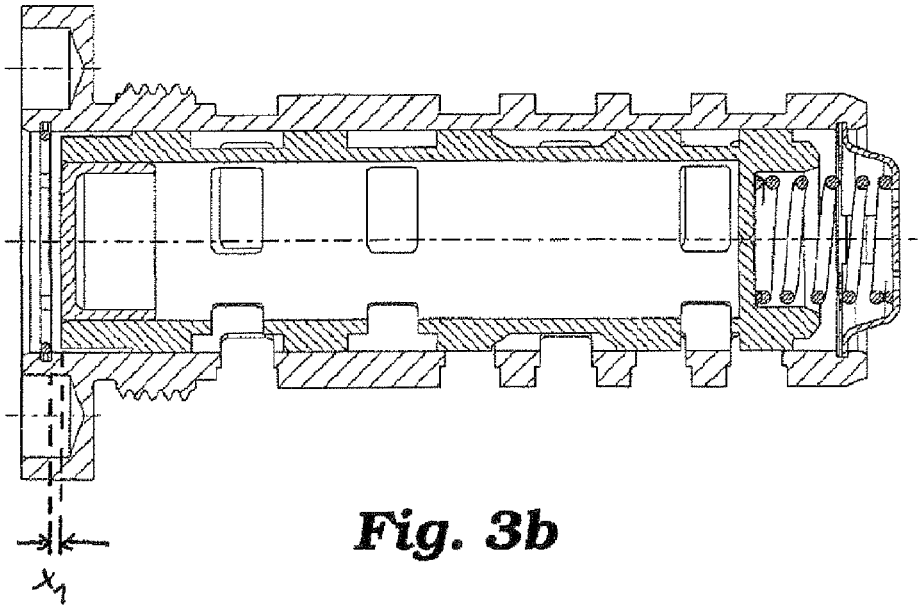

In FIG. 3*b*, the control piston 54 is displaced by the distance $x_1$ relative to the valve housing 52 against the force of the spring 55. Hydraulic fluid, which is delivered to the control valve 37 via the inlet connection P, passes via the interior of the control piston 54 to the first control chamber 56*a* and from there to the second working connection B and the control connection S. At the same time, a hydraulic fluid flow to the first working connection A is blocked by the third annular web 58*c*. The first working connection A is still connected to the outlet connection T by means of the fourth control chamber 56*d*. The first annular web 58*a* separates the control connection S from the axial outlet connection $T_a$.

Hydraulic fluid consequently passes from the hydraulic fluid pump 47 via the control valve 37 to the second pressure chambers 36 and the slotted links 45, while hydraulic fluid is discharged from the first pressure chambers 35 to the tank 49.

The rotational angle limiting devices 42, 43 are therefore brought into the unlocked state. At the same time, the hydraulic fluid flow to the second pressure chambers 36 and the hydraulic fluid discharge from the first pressure chambers 35 produces a phase adjustment towards retarded timing.

Figure 3C:
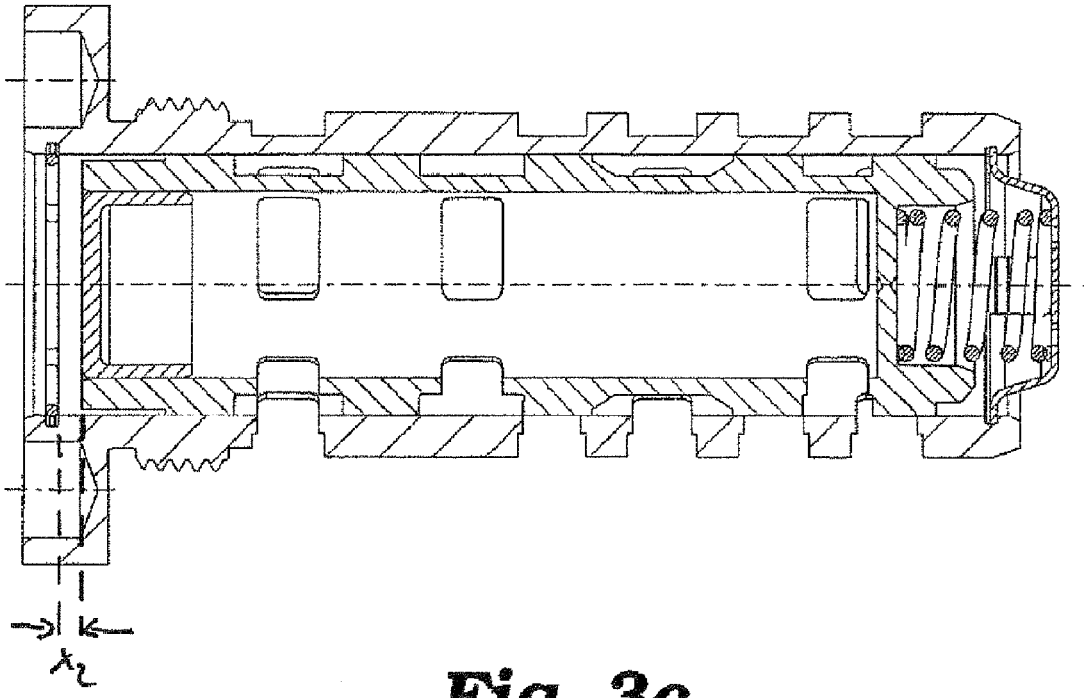

In FIG. 3*c*, the control piston 54 is displaced by the distance $x_2>x_1$ relative to the valve housing 52 against the force of the spring 55. Hydraulic fluid, which is delivered to the control valve 37 via the inlet connection P, passes via the interior of the control piston 54 to the first control chamber 56*a* and from there to the control connection S. At the same time, a hydraulic fluid flow to both working connections A, B is blocked by the second and third annular webs 58*b,c* respectively. At the same time, the second and the third annular webs 58*b,c* block the connection between each of the working connections A, B and the outlet connection T. The first annular web 58*a* continues to separate the control connection S from the axial outlet connection $T_a$.

Hydraulic fluid consequently passes from the hydraulic fluid pump 47 via the control valve 37 to the slotted links 45, while hydraulic fluid is neither delivered to nor discharged from the pressure chambers 35, 36. The actuation device 11 is therefore hydraulically set, that is to say, no phase adjustment occurs between the inner rotor 23 and the outer rotor 22.

Figure 3D:
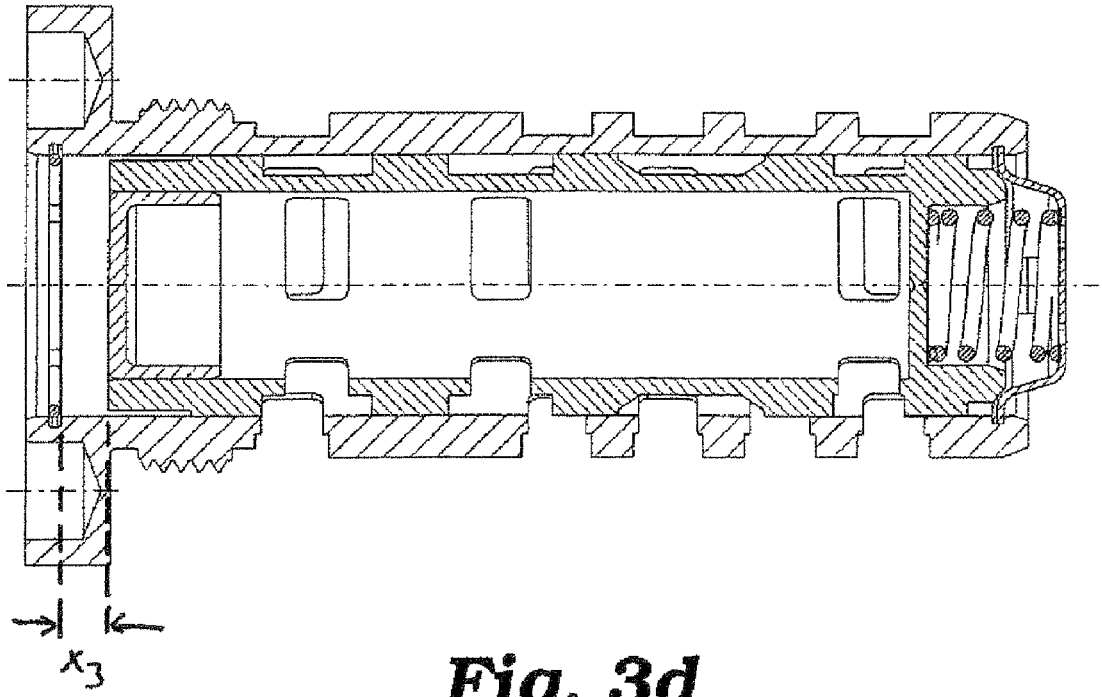

In FIG. 3*d*, the control piston 54 is displaced by the distance $x_3>x_2$ relative to the valve housing 52 against the force of the spring 55. Hydraulic fluid, which is delivered to the control valve 37 via the inlet connection P, passes via the interior of the control piston 54 to the first control chamber 56*a* and from there to the control connection S. At the same time, the hydraulic fluid passes via the interior of the control piston 54 and the second piston apertures 57*b* into the second control chamber 56*b* and from there to the first working connection A. A connection between the inlet connection P and the second working connection B is blocked by the second annular web 58*b*. Similarly, a hydraulic fluid flow from the first working connection A to the outlet connection T is blocked by the third annular web 58*c*. The second working connection B is connected to the outlet connection T by means of the fourth control chamber 56*d*. The first annular web 58*a* continues to separate the control connection S from the axial outlet connection $T_a$.

Hydraulic fluid consequently passes from the hydraulic fluid pump 47 via the control valve 37 to the first pressure chambers 35 and the slotted links 45, while hydraulic fluid is discharged from the second pressure chambers 36 to the tank 49.

The rotational angle limiting devices 42, 43 are consequently brought into the unlocked state. At the same time, the hydraulic fluid flow to the first pressure chambers 35 and the hydraulic fluid discharge from the second pressure chambers 36 produce a phase adjustment towards retarded timing.

The control valve 37 shown serves firstly for adjusting the phase position of the inner rotor 23 relative to the outer rotor 22. In addition, the locking states of the rotational angle limiting devices 42, 43 can be controlled via a separate control connection S. Separating the control connection S from the working connections A, B reduces the risk of accidental locking and unlocking of the rotational angle limiting devices 42, 43. In addition, the control logic with regard to the control connection S can be implemented independently of that of the working connections A, B and therefore tailored to the respective application. Delivering the hydraulic fluid to one of the working connections B and to the control connection S via a common control chamber 56*a*, simplifies the structure of the control piston 54. Instead of the five or six control chambers needed in the state of the art, the control valve 37 has only four control chambers 56*a-d* for the same functionality. This leads to a significant simplification of the control piston 54. In addition, the number of control edges that have to be intricately produced (boundaries of the control chambers 56*a-d*) is reduced to a minimum. The control piston 54 can therefore be manufactured more cost effectively and consistently. In addition, the control piston 54 can be of shorter design in an axial direction, thereby considerably reducing the overall dimensions of the control valve 37, which is arranged in areas of the internal combustion engine 1 where overall space is critical. This applies both to embodiments in the form of inserted valves (arrangement of the control valve 37 outside the actuation device 11), in which the actuation unit and the hydraulic section 51 are connected together, and to central valve applications (FIG. 2*b*), in which the hydraulic section 51 is formed separately from the actuation unit and is arranged in the socket 40 of the actuation unit 11.

Embodiments in which the first working connection A and the control connection S are interchanged are also feasible.

REFERENCE NUMERALS

1 Internal combustion engine
2 Crankshaft
3 Piston
4 Cylinder
5 Flexible drive
6 Inlet camshaft
7 Outlet camshaft
8 Cam
9*a* Inlet gas exchange valve
9*b* Outlet gas exchange valve
10 Device
11 Actuation device
12 Hydraulic system
21 Chain sprocket
22 Outer rotor
23 Inner rotor
24 Side cover
25 Side cover
26 Hub element
27 Vane
28 Vane grooves
29 Circumferential wall
30 -
31 Axial aperture
32 Fastening element
33 Pressure compartment
34 Boundary wall
34*a* Advance limit stop
34*b* Retard limit stop
35 First pressure chamber
36 Second pressure chamber
37 Control valve
38*a* First hydraulic fluid line
38*b* Second hydraulic fluid line
39 Axial bore
40 Socket
41 Locking mechanism
42 Rotational angle limiting device
43 Rotational angle limiting device
44 Locking pin
45 Slotted link
46 Spring element
47 Hydraulic fluid pump
48 Control line
49 Tank
50 First annular groove
51 Hydraulic section
52 Valve housing
53 Second annular groove
54 Control piston
55 Spring
55*a* Spring plate
56*a* First control chamber
56*b* Second control chamber
56*c* Third control chamber
56*d* Fourth control chamber
57*a* First piston aperture
57*b* Second piston aperture
57*c* Third piston aperture
58*a* First annular web
58*b* Second annular web
58*c* Third annular web
58*d* Fourth annular web
58*e* Fifth annular web
59 Limit stop
A First working connection
B Second working connection
P Inlet connection
S Control connection
T Outlet connection
$T_a$ Axial outlet connection
$x_1$-$x_4$ Displacement
S1 First control position
S2 Second control position
S3 Third control position
S4 Fourth control position

The invention claimed is:

1. A device for variably adjusting timing control of gas exchange valves of an internal combustion engine, comprising:

a drive element;

an output element;

a rotational angle limiting device;

a control valve;

at least two pressure chambers, acting in opposition to one another, it being possible to initiate a phase adjustment between the output element and the drive element by admitting hydraulic fluid to one of the pressure chambers while simultaneously discharging the other of the pressure chambers, the rotational angle limiting device, in a locked state, preventing a variation of phase position, the rotational angle limiting device in an unlocked state allowing a variation of the phase position, it being possible to bring the rotational angle limiting device from the locked to the unlocked state by the admission of hydraulic fluid, the control valve comprising a valve housing and a control piston, in each case at least one inlet connection, one outlet connection, a first working connection and a second working connection and a third working connection being formed on the valve housing, the inlet connection being connected to a hydraulic fluid source (47), the outlet connection being connected to a tank, the control connection being connected to the rotational angle limiting device and the first working connection and the second working connections each being connected to one of the pressure chambers and the first working connection, the second working connection and the control connection being axially offset in relation to one another and being designed not to overlap on the valve housing, wherein a first control chamber, via which two of the working connections, which are arranged directly adjacent to one another, can be selectively connected to or separated from the inlet connection according to a position of the control piston inside the valve housing, is formed on an external lateral surface of the control piston.

2. The device of claim 1, wherein the control piston is capable of assuming positions relative to the valve housing in which directly adjacent working connections communicate simultaneously with a first control chamber.

3. The device of claim 1, wherein a second control chamber, via which the working connection that does not communicate directly with a first control chamber can be selectively connected to or separated from the inlet connection according to the position of the control piston inside the valve housing, is formed on the external lateral surface of the control piston.

4. The device of claim 1, wherein the control piston is substantially of rotationally symmetrical design.

5. The device of claim 1, wherein the valve housing is substantially of rotationally symmetrical design.

6. The device of claim 1, wherein the first working connection, the second working connection and the control connection are radial apertures in the valve housing.

7. The device of claim 3, wherein the first working connection, the second working connection, the inlet connection, the control connection and the outlet connection are arranged axially offset in relation to one another and in the outlet connection, the second working connection, the control connection or the inlet connection, the control connection, the outlet connection, the second working connection, the first working connection.

8. The device of claim 1, wherein the control valve is arranged in a central socket of the output element, and the inlet connection is arranged axially outside the output element and the drive element.

9. The device of claim 1, wherein the control piston is of hollow design and an interior of the control piston communicates at least with the inlet connection and a first control chamber.

10. The device of claim 9, wherein a third control chamber, which opens into the interior of the control piston and which communicates with the inlet connection in all positions of the control piston relative to the valve housing, is formed on the external lateral surface of the control piston.

11. The device of claim 1, wherein a fourth control chamber, via which one of the adjacent working connections and the working connection that does not communicate directly with a first control chamber can be selectively communicate directly with a first control chamber can be selectively connected to or separated from the outlet connection according to the position of the control piston inside the valve housing, is formed on the external lateral surface of the control piston.

12. The device of claim 1, wherein the first control chamber, the second control chamber, the third control chamber and the fourth control chamber are annular grooves on the external lateral surface of the control piston.

* * * * *